US012102234B2

(12) United States Patent
Caforio

(10) Patent No.: US 12,102,234 B2
(45) Date of Patent: Oct. 1, 2024

(54) SYSTEM FOR SUPPORTING A HUMAN BODY OR A HUMAN BODY SEGMENT

(71) Applicant: PRO MEDICARE S.R.L., Mesagne (IT)

(72) Inventor: Rosaria Eugenia Caforio, Mesagne (IT)

(73) Assignee: PRO MEDICARE S.R.L., Mesagne (BR) (IT)

( * ) Notice: Subject to any disclaimer, the term of this patent is extended or adjusted under 35 U.S.C. 154(b) by 219 days.

(21) Appl. No.: 17/642,761

(22) PCT Filed: Sep. 16, 2020

(86) PCT No.: PCT/IB2020/058610
§ 371 (c)(1),
(2) Date: Mar. 14, 2022

(87) PCT Pub. No.: WO2021/053533
PCT Pub. Date: Mar. 25, 2021

(65) Prior Publication Data

US 2022/0330708 A1 Oct. 20, 2022

(30) Foreign Application Priority Data

Sep. 17, 2019 (IT) ..... 102019000016550

(51) Int. Cl.
*A47C 23/00* (2006.01)
*A47C 7/02* (2006.01)
*A47C 7/42* (2006.01)

(52) U.S. Cl.
CPC ..... *A47C 23/005* (2013.01); *A47C 7/0213* (2018.08); *A47C 7/425* (2013.01)

(58) Field of Classification Search
CPC ..... A47C 23/005; A47C 7/0213; A47C 7/425; A47C 7/029; A47C 7/14; A47C 7/021;
(Continued)

(56) References Cited

U.S. PATENT DOCUMENTS 3,542,421 A 11/1970 Ambrose
6,009,578 A * 1/2000 Davis ..... A61G 5/1045 297/219.1

(Continued)

FOREIGN PATENT DOCUMENTS

WO WO-2011121249 A1 * 10/2011 ..... A47C 7/021

OTHER PUBLICATIONS

International Search Report and Written Opinion of the International Searching Authority issued for International PCT Application No. PCT/IB2020/058610 on Nov. 11, 2020.

*Primary Examiner* — Justin C Mikowski
*Assistant Examiner* — Madison Emanski
(74) *Attorney, Agent, or Firm* — Howson & Howson LLP

(57) ABSTRACT

A system for supporting the human body or a human body segment is provided. The system comprises a base element having a substantially flat shape, and one or more pluralities of shaped modular elements. The base element is flexible, so that it can be brought from an operating, extended configuration to a non-operating, folded configuration. The support system comprises one or more stiffening elements, which are designed in such a way that, on the one hand, they provide the correct stiffness to the backrest when in the operating configuration, and, on the other hand, they do not prevent the possibility of folding the backrest when in the non-operating configuration. The support system can, for example, be made in the form of a seat, a backrest, a mattress, or the like.

18 Claims, 4 Drawing Sheets

(58) Field of Classification Search
CPC ..... A47C 27/148; A47C 7/144; A47C 7/18; A47C 31/12; A47C 31/126; A61G 5/1091; A61G 5/1045; A61G 5/1043; A61G 5/1048; A61G 2210/10; B60N 2/60
USPC ..... 297/219.1, 284.3, 183.1, 183.5, 228.13, 297/229, 230.12; 5/722, 652, 657, 632, 5/640
See application file for complete search history.

(56) References Cited

U.S. PATENT DOCUMENTS

| | | | | |
|---|---|---|---|---|
| 8,713,733 | B2 | 5/2014 | Caforio | |
| 10,881,218 | B2 * | 1/2021 | Mascull | A61G 5/1048 |
| 2015/0189996 | A1 | 7/2015 | Scarlett et al. | |
| 2016/0106217 | A1 | 4/2016 | Bates | |
| 2016/0166080 | A1 | 6/2016 | Mascull et al. | |

* cited by examiner

SYSTEM FOR SUPPORTING A HUMAN BODY OR A HUMAN BODY SEGMENT

TECHNICAL FIELD

The present invention relates to a system for supporting a human body or a human body segment.

More particularly, the present invention relates to a system for supporting a human body, or a segment thereof, which has a modular structure adapted to properly conform to the specific morphology of a single individual and his/her needs.

Said support system can, for example, be made in the form of a seat, suitable to be placed onto a support element, in the form of a backrest, suitable to be mounted between a pair of support uprights, in the form of a mattress, suitable to be mounted on a support frame, etc.

By way of non-limiting example, the present invention finds application in the making of supporting systems for ill or disabled people, and can be applied to medical devices for aiding mobility, such as manual and/or electronic wheelchairs, as well as to medical devices for rehabilitation and social or home life, such as bases with or without wheels for indoor and/or school use, etc.

BACKGROUND ART

Correct posture is affected by countless factors and is essential for the physical well-being of the individual.

In particular, though without limitation, ensuring correct posture is essential to those people suffering from diseases, genetic or acquired, resulting from damage to the central nervous system, who do not have self-control mechanisms that, by reacting to external stimuli, would allow them to avoid assuming incorrect postures.

Some pathologies resulting from damage to the central nervous system also involve changes in body structure, which in turn lead to limitations of basic body functions, such as breathing, swallowing, communication, etc. For these people, a correct sitting or lying posture is even essential for their survival.

More generally, even for people who are in good health, there is a need for support systems for the human body that are adapted to the specific morphology of the individual and that allow them to maintain the correct posture, for example during work or during sleep hours.

Such systems of support and restraint of the different segments of the human body are known from the state of the art.

In particular, support systems are known from the state of the art, which take into account the particular morphology of the individual subject.

To this end, said support systems have a modular structure, consisting of a base element and one or more pluralities of interchangeable modules, each plurality of modules corresponding to a different body segment.

In this way, the most suitable modules of each plurality of modules can be selected and correctly positioned on the base element, in order to obtain the most suitable final overall configuration.

By way of example, International patent application WO 2011/148329, in the name of the same Applicant, describes a postural system having a wholly modular nature and providing a support structure (base element) made as a flat base plate, and several pluralities of shaped blocks, provided with means for removable and reversible connection to said base plate and to one another. In this way, the number, shape and arrangement of said shaped blocks can be selected each time according to the morphology of the individual user.

In particular, the postural system described in WO 2011/148329 provides for using several pluralities of modular blocks, each plurality being intended for a different body segment (for example, a first plurality of modular blocks for the user's legs, a second plurality of modular blocks for the user's pelvis, a third plurality of modular blocks for the user's spine, etc.), whereby the postural system as a whole is able to conform to the morphological structure of the individual user.

Although a support system of the type described above can take on a configuration that perfectly conforms to the specific morphology of the individual and can be modified over time if that morphology changes, it is not without drawbacks.

In particular, the presence of a rigid supporting structure inevitably entails large overall dimensions, which can generate considerable drawbacks.

In particular, these drawbacks occur when such a support system has to be transported.

Referring, merely by way of non-limiting example, to the case where the postural system described above is made in the form of a seat and/or backrest for application to a wheelchair for the disabled, it is clear that the presence of a rigid supporting structure entails a series of drawbacks, particularly when the wheelchair must be stored during periods of non-use.

In fact, wheelchairs for the disabled generally have a folding load-bearing frame so that they can be folded when not in use, so that their overall dimensions are significantly reduced when not in use.

The provision of a folding load-bearing frame is particularly important if the wheelchair is to be transported, for example on a vehicle.

The provision of a postural system including a rigid base element applied to the wheelchair supporting frame eliminates the possibility of folding said frame.

Therefore, the wheelchair takes up considerable space even when not in use.

Alternatively, in order to be able to fold the frame of the wheelchair (e.g. in the case of transport on a vehicle), the postural system must be removed from the frame so that the frame can be folded.

In any case, the overall dimensions of the postural system—which add to those of the support frame—cannot be reduced.

Furthermore, by removing and re-applying the postural system to the support frame every time it has to be folded down, there is a risk of placing the postural system in a different and incorrect position.

As highlighted above, it is of fundamental importance that the postural system adapts perfectly to the user's morphology. As a result, even small positioning or alignment errors can lead to a considerable reduction in the user's comfort (or even more serious health problems in the specific case where the support system is intended for an individual suffering from particular pathologies).

The main object of the present invention is to overcome the drawbacks highlighted above by providing a support system for the human body, or for a segment of the human body, which can switch from an operating configuration, which adapts to the user's morphology and guarantees comfort, to a non-operating configuration, in which its overall dimensions can be reduced.

These and other objects are achieved by a support system as claimed in the appended claims.

SUMMARY OF INVENTION

The support system according to the invention is a modular system comprising a base element, having a substantially flat shape, and one or more pluralities of shaped modular elements, which are provided with means for coupling in a removable and reversible manner to said base element and to one another.

According to the invention, said base element is flexible, so that it can be brought from an operating, extended configuration to a non-operating, folded configuration.

Firstly, thanks to the provision of a flexible base element, the overall dimensions of the support system according to the invention can be significantly reduced when said support system is not in use.

Secondly, if said support system is applied to a folding load-bearing frame (such as the folding load-bearing frame of a wheelchair for the disabled), it can be folded and extended together with said load-bearing frame, thus eliminating the need to remove it and put it back in place each time.

This second advantage is particularly relevant because it eliminates the risk of the support system being repositioned incorrectly and not according to the user's specific morphology.

According to a first preferred embodiment of the invention, said base element is made as a base plate having a substantially flat shape and made of a flexible material.

According to a second preferred embodiment of the invention, said support system comprises a lining made of a flexible material and said base element consists of a wall of said lining of flexible material.

It should be noted that state of the art cushioning arrangements are known which include a flexible base element with a substantially flat shape and one or more pluralities of shaped modular elements, provided with means to be connected in a removable and reversible way to said base element and to one another.

By way of example, document U.S. Pat. No. 3,542,421 refers to a cushioning arrangement comprising a panel made of a flexible material and provided with areas on its surface with interconnecting means for the removable connection of padded inserts, which in turn are provided with interconnecting means to be applied to said panel in the desired position.

However, the cushioning arrangement described in U.S. Pat. No. 3,542,421 is not per se capable of providing support for the user's body or a segment thereof: it is rather intended to be associated with an external support element, such as a backrest, and for this purpose it is equipped with means of connection to a backrest.

Similarly, document WO 2014/038961 describes a cushioning arrangement that includes a flexible substrate and a number of cells of different shapes and sizes, which can be removably associated with the substrate in the desired position.

In this case, too, the cushioning arrangement described in WO 2014/038961 cannot per se provide support for the user's body or a segment thereof and the substrate is equipped with means of attachment in order to be fixed to an external support element, such as a backrest.

Therefore, while the cushioning arrangements described in U.S. Pat. No. 3,542,421 and WO 2014/038961are able to offer a more or less customizable bearing surface for the user's body or a segment thereof, they are not able to provide adequate support for the user's body or a segment thereof. For this reason, they are intended to be applied to existing, traditional support elements. For example, they are intended to be applied to the backrest of a wheelchair, which will have its own structure.

On the contrary, the invention does not have as its object a cushioning arrangement to be applied to an existing support system, but its object is rather to provide a support system capable per se of providing the required support for the user's body or a segment thereof.

In other words, the support system according to the invention could be defined as "self-supporting", since—when it is in its operating position—it provides per se the appropriate support and does not need to be coupled to external, traditionally-made support systems.

In order to be able to correctly support the user in its operating configuration, the support system according to the invention therefore comprises one or more stiffening elements, which can be brought from an operating configuration to a non-operating configuration together with the flexible base element.

According to a preferred embodiment of the invention, in order to be able to support the user correctly in its operating configuration, the support system according to the invention includes one or more stiffening elements which are themselves flexible, so that they can be brought from the extended position to the folded position, and vice versa, together with the base element.

According to an alternative embodiment of the invention, in order to be able to support the user correctly in its operating configuration, the support system according to the invention includes one or more stiffening elements that are removable, so that they can be removed when the base element has to be brought from the extended position to the folded position.

BRIEF DESCRIPTION OF DRAWINGS

Further features and advantages of the invention will become apparent from the ensuing description of a preferred embodiment of the invention, given by way of non-limiting example, with reference to the annexed drawings, in which.

DESCRIPTION OF EMBODIMENTS

In the ensuing description of a preferred embodiment of a support system for supporting a human body according to the invention, reference will be made to a support system made in the form of a backrest, in particular a backrest for a wheelchair for the disabled.

However, this embodiment should not be interpreted in a limiting sense and the support system according to the invention could be realized in many different ways, each one capable of supporting one or more body segments of the user.

For example, the support system according to the invention could be made in the form of a seat, in the form of a mattress, in the form of an armchair including a seat and a backrest, or in many other forms.

In addition, the support system may not necessarily be intended for people who are ill or disabled.

Figure 1:
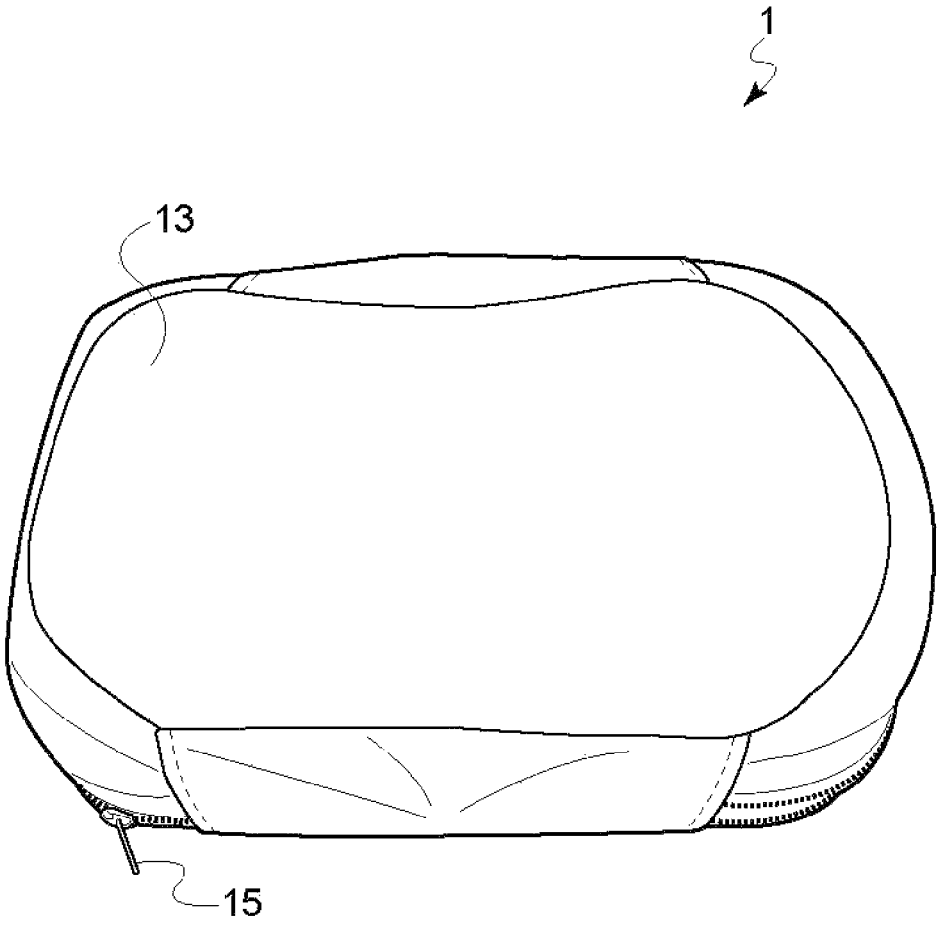
FIG. 1 shows a support system according to a preferred embodiment of the invention, illustrated in first or operating configuration.

Referring to FIG. 1, in the illustrated embodiment, the support system has the form of a backrest 1, which is shown in its operating position or extended position in this Figure.

Figure 2:
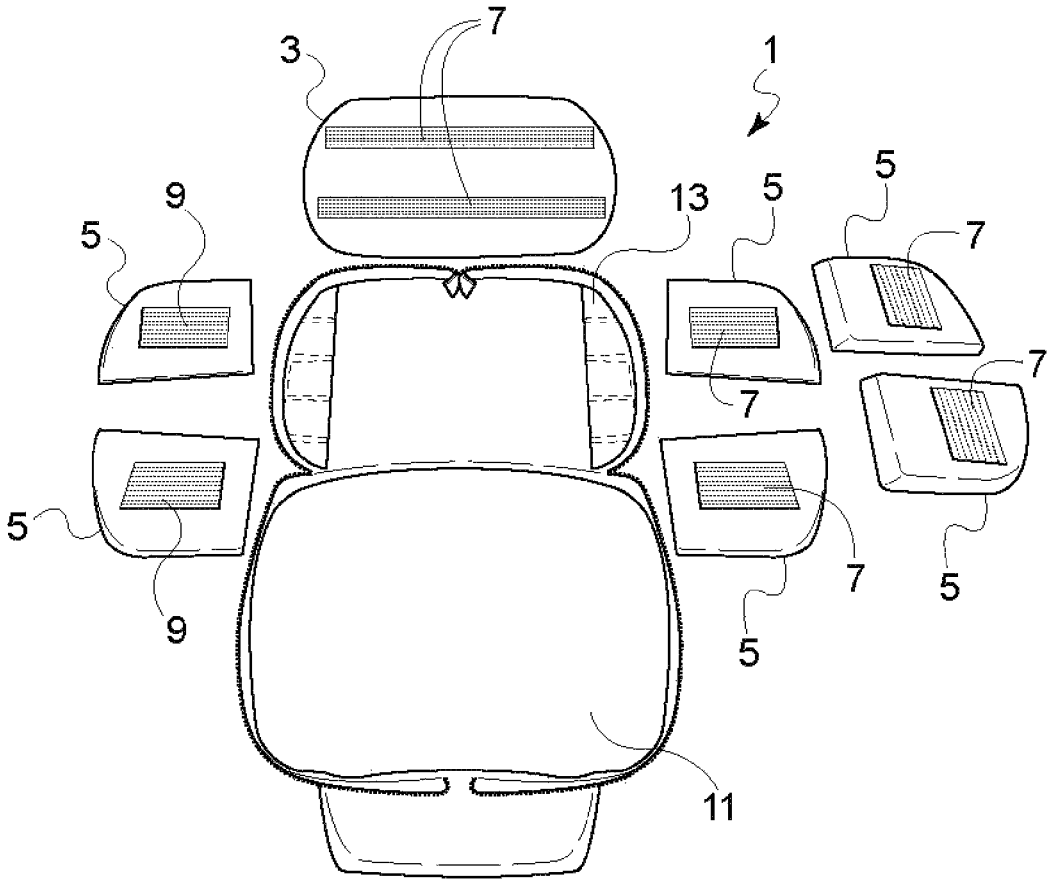
FIG. 2 shows the support system of FIG. 1, broken down into its modular elements.

The structure of the backrest 1 can be better understood from FIG. 2.

Said backrest 1 comprises a base element 3 having a substantially flat shape.

In particular, in the illustrated embodiment, said base element is made in the form of a substantially flat base plate 3.

Said backrest 1 further comprises a plurality of shaped modular elements 5.

Said modular elements 5 can be made of a plastic or composite material, are pre-formed and can be adapted by cutting, material removal or other similar working processes.

Alternatively, said modular elements 5 could be made by using multi-pocket elements, in which each pocket can be filled with materials having different properties, which makes it possible to obtain a system with different stiffnesses.

The base element 3 has a surface (top surface) provided with coupling means 7 for coupling to said modular elements 5.

Correspondingly, each of the modular elements 5 is provided, over a surface thereof (bottom surface), with coupling means 9 for coupling to the base element 3.

In particular, the coupling means 9 of the modular elements 5 are selected so as to cooperate with the coupling means 7 of the base element 3 so as to achieve a coupling between said base element and said modular elements.

More specifically, the coupling means 7, 9 are selected so as to achieve a coupling between the base element and the modular elements that allows these modular elements to be applied to this base element in adjustable positions and removed from it if repositioning is necessary.

Said coupling means 7, 9 can, for example, be made up of coupling systems with binder locking systems and/or male and/or female hook-and-loop straps.

The realization of the backrest 1 by coupling the modular elements 5 to the base element 3 allows, by fixing said modular elements 5 independently from one another in the desired position, to obtain each time the configuration most suitable for the specific morphology of the individual user.

It will be evident to the person skilled in the art that the modular elements 5 can suitably be designed with different sizes, shapes, dimensions and functions in order to increase the versatility of the backrest 1.

The backrest 1 is further provided with a padding 11, adapted to be superimposed on the modular elements 5 and, thus, to be sandwiched, in use, between the modular support structure consisting of the base element 3 and the modular elements 5 and the user's back (or, more generally, the segment of the user's body).

Advantageously, the padding 11, too, could have a modular structure, and include a plurality of padded cushions, with the same or different shape and thickness, suitably combined according to the load to be borne by the padding and the stresses to which the padding is during use.

The padding 11 or the padded cushions forming the padding can be made by using different types and combinations of high-performance polymer foams, cross-linked foams to promote ventilation, visco-elastic slow rebound memory foams and similar materials.

Alternatively, said padding 11 or the padded cushions forming said padding can be made by using multi-pocket elements, in which each pocket can be filled with materials having different properties, which makes it possible to obtain a system with different stiffnesses.

The backrest 1 further comprises a covering lining 13 inside which the base element 3, the base elements 5 and the padding 11 are received.

Said covering lining 13 is provided with a zipper 15 or similar closing system that allows access to the elements inside it, for example if it is necessary to correct the positioning of the modular elements 5 with respect to the basic element 3

Figure 3:
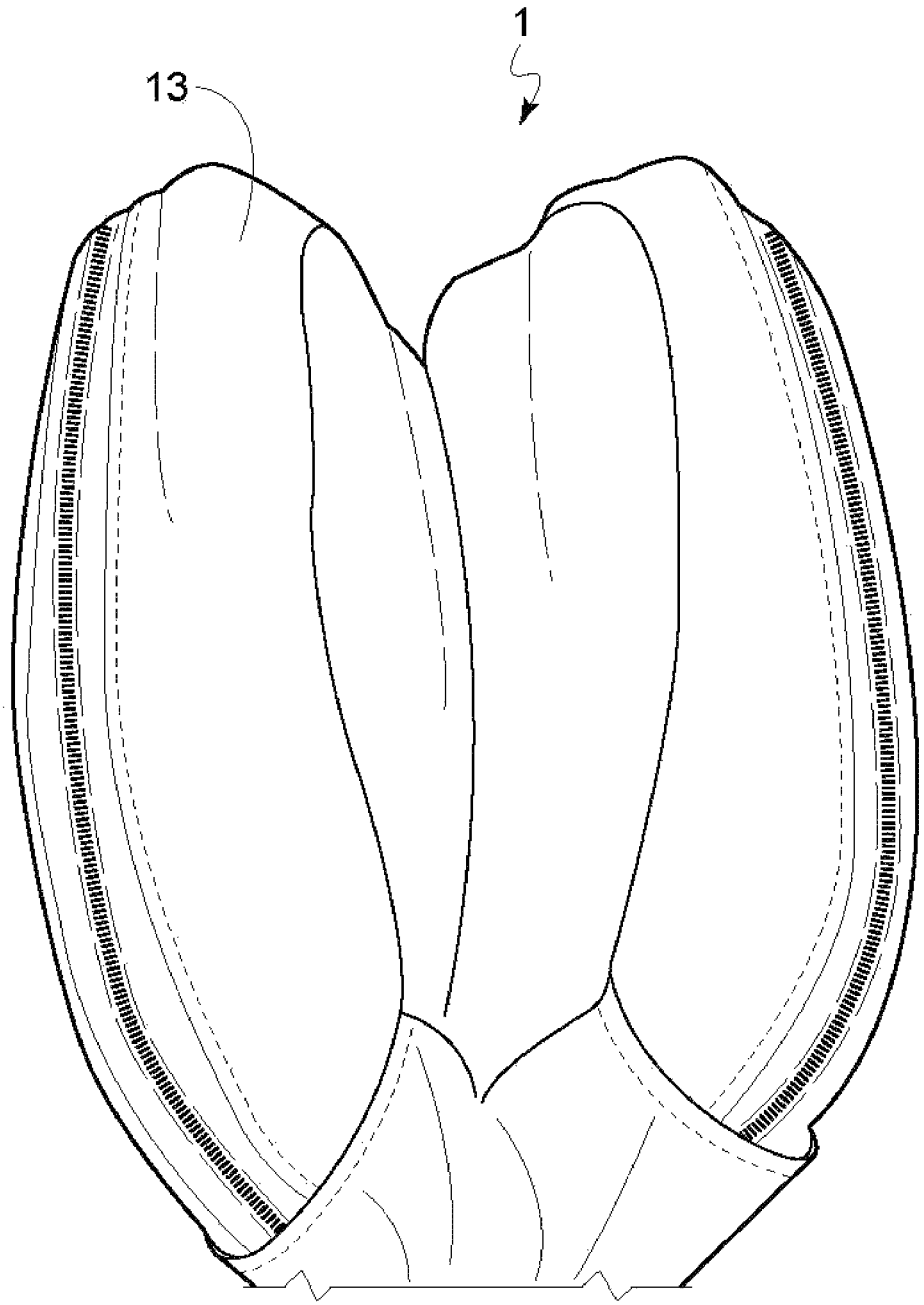
FIG. 3 shows the support system of FIG. 1, illustrated in a second or non-operating configuration.

According to the invention, the base element 3 of the backrest 1 is flexible, so that it can be brought from the operating, extended configuration shown in FIG. 1 to a non-operating, folded configuration shown in FIG. 3, and vice versa.

Advantageously, as can be seen from FIG. 3, thanks to the presence of the flexible base element 3, the overall dimensions of the backrest 1 can be significantly reduced when not in use.

Above all, if said backrest 1 is applied to the folding load-bearing frame of a wheelchair for the disabled or a similar medical device for mobility or rehabilitation, it can be folded and extended together with said load-bearing frame, thus eliminating the need to remove it and put it back in position every time.

As will be evident to the person skilled in the art, this measure eliminates the risk that the backrest 1 is positioned incorrectly and not according to the user's specific morphology.

It should be noted that in an alternative embodiment of the invention, the base element 3—rather than being a specially designed base plate—could consist of a wall of the lining 13, in particular of the wall 13*a* of said lining which—in use—is further away from the user's body.

In this alternative embodiment, the inner face of the wall 13*a* of the liner 13 will be suitably provided with coupling means to cooperate with the coupling means 9 of the modular elements 5.

While the presence of a flexible base element ensures the above mentioned advantages, it is also necessary to ensure that the backrest 1 provides the user with the correct support when in use.

For this purpose, the backrest 1 is preferably provided with one or more stiffening elements, which are designed in such a way that, on the one hand, they provide the correct stiffness to the backrest 1 when in the operating configuration, and, on the other hand, they do not prevent the possibility of folding the backrest 1 when in the non-operating configuration.

In the preferred embodiment of the invention illustrated herein, the backrest according to the invention comprises one or more stiffening elements, which are also flexible, so as not to hinder folding of the backrest.

Figure 4:
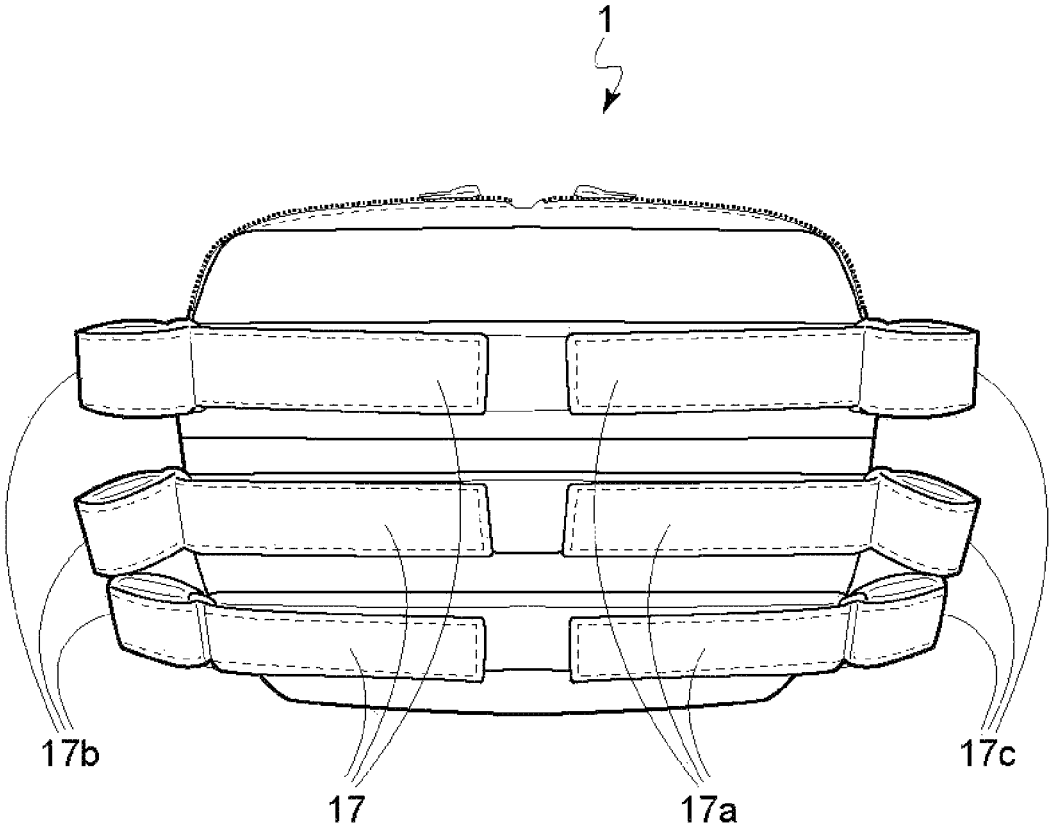
FIG. 4 shows the stiffening elements of the support system of FIG. 1.

In particular, in the preferred embodiment of the invention illustrated herein, the backrest according to the invention comprises a plurality of tensionable straps 17, visible in FIG. 4.

As shown in FIG. 4, said tensionable straps 17 can be applied to the face of the backrest 1 which, in use, is opposite to the face oriented towards the user's back.

The straps 17 comprise a central portion 17*a* which is applied to the backrest 1 and opposite annular end portions 17*b*, 17*c* adapted to be fixed to respective uprights of the load-bearing frame.

The straps 17 have an adjustable length, so that they can be tensioned by reducing their length and they can be released by increasing their length.

In this way, they can be tensioned when the backrest is in use, so as to ensure the correct stiffness of said backrest, and can be loosened when the backrest is not in use, so as to allow folding thereof.

Accordingly, the straps 17 can be permanently applied to the backrest 1.

In any case, they could also be coupled to said backrest is a removable manner, for example by using male and female hook-and-loop strips or similar coupling means.

In an alternative embodiment of the invention, the backrest according to the invention can include a stiffening element, which is removable, so that it can be removed when the basic element has to be brought from the extended position to the folded position.

Said stiffening element can, for example, be made as a thin rigid sheet applied to the base element 3 on the face opposite to the padding 11.

Thanks to the zipper 15, the lining 13 can be opened and the rigid sheet can be pulled out when the backrest 1 is to be folded.

It is evident from the above description that the support system according to the invention allows to achieve the objects set forth above, being capable of being brought from an operating, extended configuration to a folded, non-operating configuration, and this without jeopardizing the comfort and correct support for the user in its operating configuration.

It is also evident that the embodiment described above has been given merely by way of example and that numerous modifications and variations are possible without leaving the scope of protection of the invention, as defined by the appended claims.

The invention claimed is:

1. A support system for supporting a human body or a human body segment, the support system comprising a base element, having a flat shape, and a plurality of shaped modular elements, wherein the base element is provided with coupling means and the modular elements are provided with corresponding coupling means, the coupling means of the base element and the coupling means of the modular elements cooperating for coupling the modular elements to the base element, wherein the base element has a middle longitudinal axis, dividing the base element in two portions along a first, longitudinal direction, and a middle transverse axis, dividing the base element in two portions along a second, transverse direction that is perpendicular to the first longitudinal direction, wherein the base element is flexible, whereby the base element can be brought from an operating, extended configuration to a non-operating, folded configuration by folding the base element about the middle longitudinal axis or about the middle transverse axis, and vice versa, wherein the support system further comprises one or more stiffening elements, whereby the support system is able to support the human body or the human body segment in the operating configuration due to the stiffening elements, and wherein the stiffening elements are brought from the operating extended configuration, to the non-operating folded configuration, together with the flexible base element.

2. The support system according to claim 1, wherein the base element is made in the form of a flexible base plate, having a flat shape with two opposite faces, and wherein the coupling means of the base element are provided on one of the opposite faces.

3. The support system according to claim 1, wherein the support system further comprises a covering lining made of flexible material, wherein the covering lining has a plurality of walls and wherein the base element is formed by one of the walls of the covering lining.

4. The support system according to claim 3, wherein a face of the wall of the covering lining forming the base element that is directed toward the plurality of modular elements is provided with the coupling means of the base element.

5. The support system according to claim 1, wherein the one or more stiffening elements are made as flexible elements.

6. The support system according to claim 5, wherein the one or more stiffening elements are tensionable straps, having an adjustable length, whereby the tensionable straps are tensioned by reducing the length of the tensionable straps and are released by increasing the length of the tensionable straps.

7. The support system according to claim 1, wherein the one or more stiffening elements are applied to the support system in a removable manner.

8. The support system according to claim 1, wherein the coupling means of the base element and the coupling means of the modular elements achieve a removable coupling between the modular elements and the base element.

9. The support system according to claim 1, wherein the support system further comprises a padding, which is superimposed on the modular elements.

10. A backrest for supporting a back of a human body, the backrest comprising: a base element, having a flat shape; and a plurality of shaped modular elements;

wherein the base element is provided with coupling means and the modular elements are provided with corresponding coupling means, the coupling means of the base element and the coupling means of the modular elements cooperating for coupling the modular elements to the base element; wherein the base element has a middle longitudinal axis that divides the base element in two portions along a first longitudinal direction and a middle transverse axis that divides the base element in two portions along a second transverse direction that is perpendicular to the first longitudinal direction; wherein the base element is flexible, whereby the base element can be brought from an operating extended configuration to a non-operating folded configuration by folding the base element about the middle longitudinal axis or about the middle transverse axis, and vice versa; wherein the backrest further comprises one or more stiffening elements, whereby the backrest is able to support the back of the human body in the operating extended configuration due to the stiffening elements; and wherein the stiffening elements are brought from the operating extended configuration to the non-operating folded configuration together with the flexible base element.

11. The backrest according to claim 10, wherein the base element is made in the form of a flexible base plate, having a flat shape with two opposite faces, and wherein the coupling means of the base element are provided on one of the opposite faces.

12. The backrest according to claim 10, further comprising a covering lining made of flexible material, wherein the covering lining has a plurality of walls and wherein the base element is formed by one of the walls of the covering lining.

13. The backrest according to claim 12, wherein a face of the wall of the covering lining forming the base element that is directed toward the plurality of modular elements is provided with the coupling means of the base element.

14. The backrest according to claim 10, wherein the one or more stiffening elements are made as flexible elements.

15. The backrest according to claim 14, wherein the one or more stiffening elements are tensionable straps having an adjustable length, whereby the tensionable straps are tensioned by reducing the length of the tensionable straps and are released by increasing the length of the tensionable straps.

16. The backrest according to claim 10, wherein the one or more stiffening elements are applied to the backrest in a removable manner.

17. The backrest according to claim 10, wherein the coupling means of the base element and the coupling means of the modular elements achieve a removable coupling between the modular elements and the base element.

18. The backrest according to claim 10, further comprising padding superimposed on the modular elements.

* * * * *